US008342472B2

(12) United States Patent
Gaudron et al.

(10) Patent No.: US 8,342,472 B2
(45) Date of Patent: Jan. 1, 2013

(54) ADJUSTABLE WALL HANGER

(75) Inventors: Paul Gaudron, Stratford, CT (US); Jacob Olsen, Roselle, IL (US)

(73) Assignee: Black & Decker Inc., Newark, DE (US)

( * ) Notice: Subject to any disclaimer, the term of this patent is extended or adjusted under 35 U.S.C. 154(b) by 198 days.

(21) Appl. No.: 12/701,079

(22) Filed: Feb. 5, 2010

(65) Prior Publication Data

US 2011/0192945 A1 Aug. 11, 2011

(51) Int. Cl.
*A47G 1/24* (2006.01)
*B60R 1/02* (2006.01)

(52) U.S. Cl. ..... 248/476; 248/475.1; 248/477; 248/489

(58) Field of Classification Search ..... 248/477, 248/480, 476, 475.1, 489; 40/759, 761
See application file for complete search history.

(56) References Cited

U.S. PATENT DOCUMENTS

| | | | | |
|---|---|---|---|---|
| 999,961 | A * | 8/1911 | Colas | 248/498 |
| 1,187,787 | A | 6/1916 | Seubert | |
| 1,959,745 | A | 5/1934 | Stout | |
| 3,330,525 | A * | 7/1967 | Weinstein | 248/496 |
| D214,590 | S | 7/1969 | Corson | |
| 3,596,392 | A * | 8/1971 | Vani | 248/222.51 |
| 4,557,457 | A * | 12/1985 | Cockfield et al. | 248/544 |
| 4,572,470 | A | 2/1986 | Siffert | |
| 4,655,351 | A * | 4/1987 | Walker | 211/88.01 |
| 4,932,146 | A | 6/1990 | Long | |
| 5,100,094 | A | 3/1992 | Handwerger et al. | |
| D337,720 | S | 7/1993 | Handwerger et al. | |
| D341,538 | S | 11/1993 | Paul | |
| D352,233 | S | 11/1994 | Le Gay | |
| D441,273 | S | 5/2001 | O'Donnell et al. | |
| 7,654,500 | B1 * | 2/2010 | Jump | 248/476 |
| 7,913,967 | B1 * | 3/2011 | Aleo | 248/476 |
| D637,063 | S * | 5/2011 | Gaudron et al. | D8/349 |

* cited by examiner

*Primary Examiner* — Amy J Sterling
(74) *Attorney, Agent, or Firm* — Cantor Colburn LLP

(57) ABSTRACT

An adjustable wall hanger includes a body including an outer edge that defines a web. An adjustment feature is formed in the web. The adjustment feature includes a plurality of adjustment zones that define a corresponding plurality of orientation positions for the body. The adjustable wall hanger being selectively positionable to support an object on a wall in one of the plurality of orientation positions.

20 Claims, 4 Drawing Sheets

ADJUSTABLE WALL HANGER

BACKGROUND

Exemplary embodiments are directed to hangers for supporting objects on a surface and, more particularly, to an adjustable wall hanger.

Conventional wall hangers exist in a wide array of designs ranging from a simple nails or screws to a robust hook system for supporting large, heavy objects. In general, a location for the object to hang on the wall is selected, the wall hanger installed, and the object supported from the wall hanger. Often times it is desirable to align the object with another object or with a feature on the wall. In such cases, it is necessary to accurately position the wall hanger. If out of position, the object will be out of alignment. If proper alignment is still desired, the wall hanger must be removed, the wall repaired, a new position selected, and the wall hanger re-installed. In certain instances, an object will be re-positioned several times before a desired final alignment is achieved.

SUMMARY

An adjustable wall hanger includes a body including an outer edge that defines a web. An adjustment feature is formed in the web. The adjustment feature includes a plurality of adjustment zones that define a corresponding plurality of orientation positions for the body. The adjustable wall hanger being selectively positionable to support an object on a wall in one of the plurality of orientation positions.

A method of selectively adjustably supporting an object on a substrate includes mounting a support member relative to the substrate in a desired location, positioning a body of an adjustable wall hanger at the support member. The method further includes selectively arranging one of a plurality of adjustment zones formed in the body upon the support member to establish a desired orientation of the object.

BRIEF DESCRIPTION OF THE DRAWINGS

Referring now to the drawings wherein like elements are numbered alike in the Figures.

DETAILED DESCRIPTION

Figure 1:
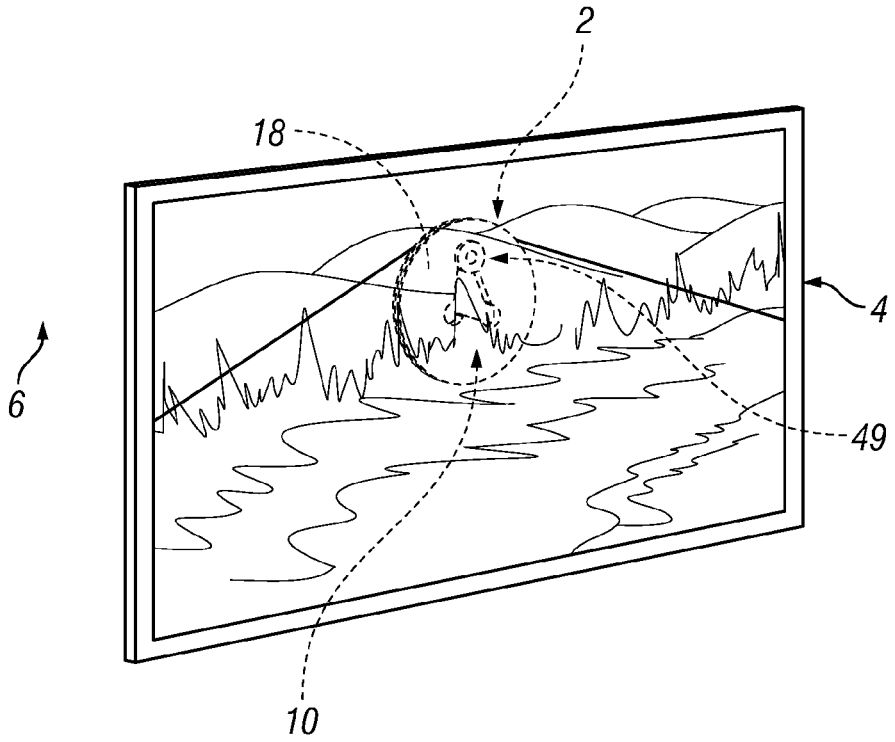
FIG. 1 is a plan view of an adjustable wall hanger supporting an object on a wall in accordance with an exemplary embodiment.

Referring to FIG. 1, an adjustable wall hanger constructed in accordance with an exemplary embodiment is indicated generally at 2. In the exemplary embodiment shown, adjustable wall hanger 2 is supporting a picture 4 upon a wall 6. However, it should be understood that adjustable wall hanger 2 can be employed to support a wide variety of objects from a wide array of structures such as walls, cabinets, doors, and the like.

Figure 2:
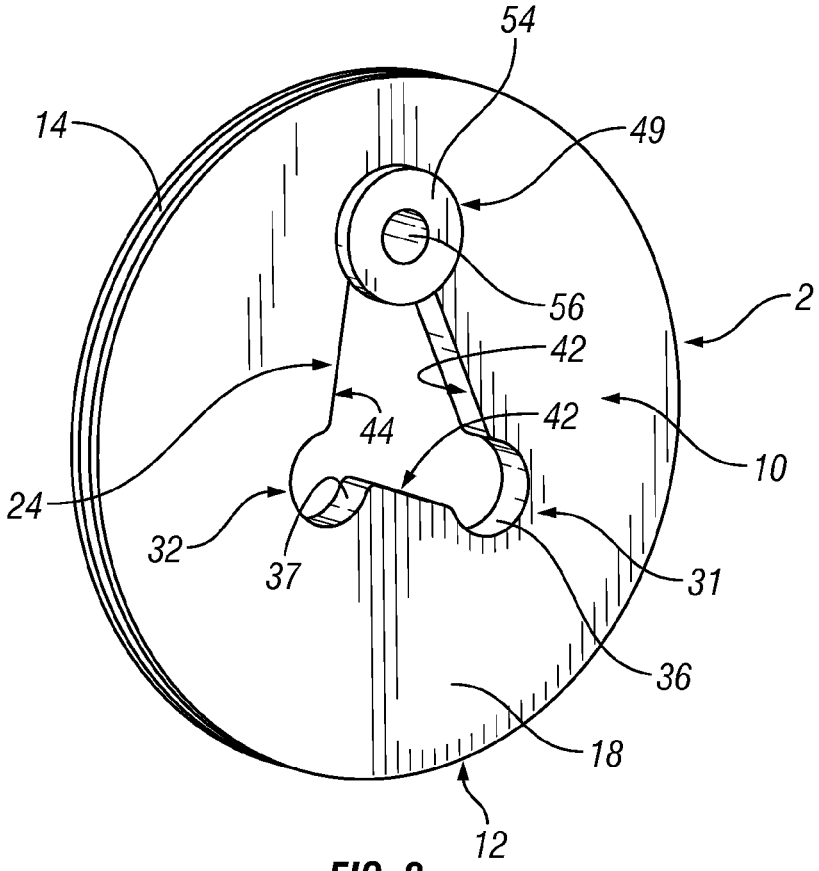
FIG. 2 is a perspective view of the adjustable wall hanger of FIG. 1.
Figure 3:
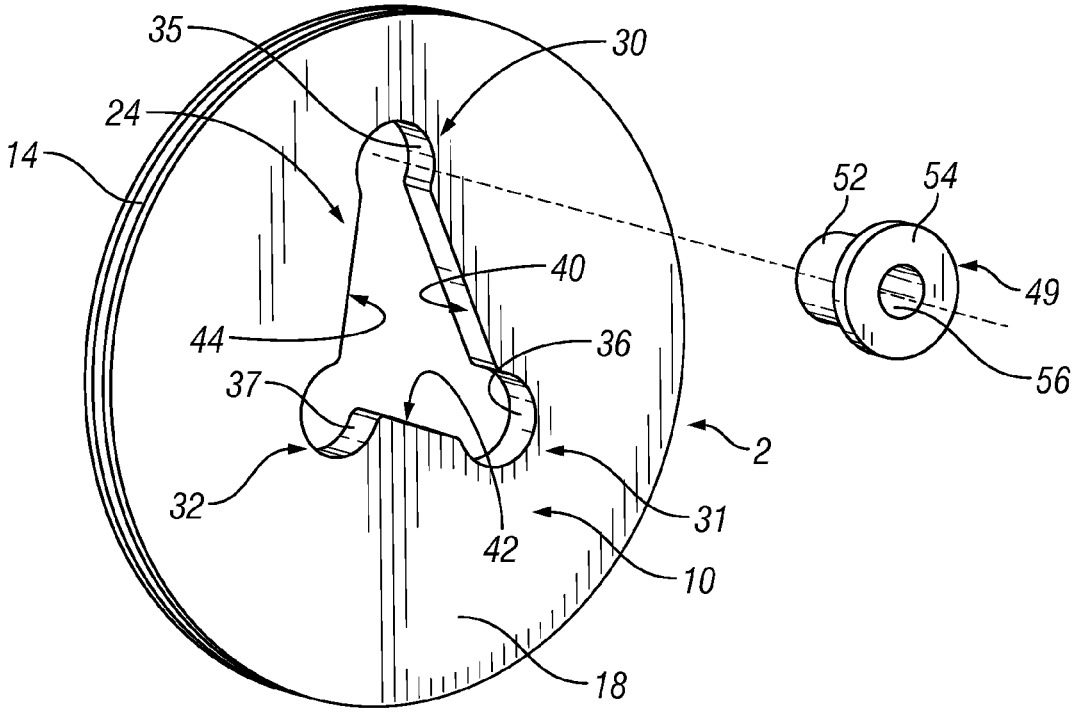
FIG. 3 is an exploded view of the adjustable wall hanger of FIG. 2.

As best shown in FIGS. 2-3, adjustable wall hanger 2 includes a body 10 having an outer edge 12 that is provided with a groove 14 for receiving a picture wire. In the exemplary embodiment shown, outer edge 12 extends continuously about body 10 defining a generally circular web 18. Of course web 18 can take on a variety of geometries without departing from the scope of the claims. Adjustable wall hanger 2 includes an adjustment feature 24, which, as will be discussed more fully below, facilitates vertical adjustments for objects supported upon body 10.

In the exemplary embodiment shown, adjustment feature 24 includes a plurality of adjustment zones 30-32 that define a corresponding plurality of distinct orientation positions 35-37 for body 10. As will be discussed more fully below, adjustment zones 30-32 are generally circular enabling body 10 to easily move into a selected one of the plurality of orientation positions 35-37. Of course while shown and described as being generally circular, adjustment zones 30-32 can take on a variety of forms. Adjustment zone 30 is connected or linked to adjustment zone 31 through a first connecting portion 40 having a first length. Similarly, adjustment zone 31 is linked to adjustment zone 32 through a second connecting portion 42 having a second length, and adjustment zone 32 is linked back to adjustment zone 30 through a third connecting portion 44, having a third length. Each of the first, second, and third connecting portions 40, 42, and 44 are generally linear, and the first, second, and third lengths are distinct thereby establishing the plurality of distinct orientation positions 35-37.

In further accordance with the exemplary embodiment shown, adjustable wall hanger 2 is configured to rest upon a pin or support member 49. Support member 49 includes a reduced diameter portion 52 configured to nest within adjustment zones 30-32 and a flange portion 54. A central bore 56 extends through flange portion 54 and reduced diameter portion 52. With this arrangement, an anchor (not shown) is installed into wall 6 and support member 49 is mounted by passing a fastener, such as a screw (also not shown), through central bore 56 to engage the anchor. Of course it should be understood that support member 49 can take on a variety of forms including both threaded and un-threaded fasteners and/or pins. Also, the particular method of mounting support member 49 to wall 6 is but one example and should not be considered to limit the scope of the claims.

Figure 4:
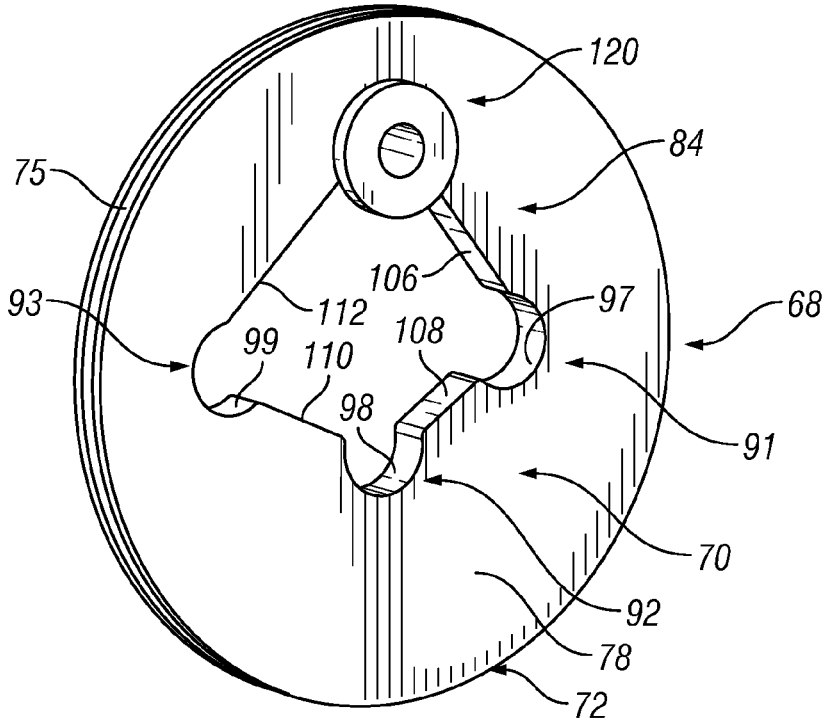
FIG. 4 is a perspective view of an adjustable wall hanger in accordance with another aspect of the exemplary embodiment.
Figure 5:
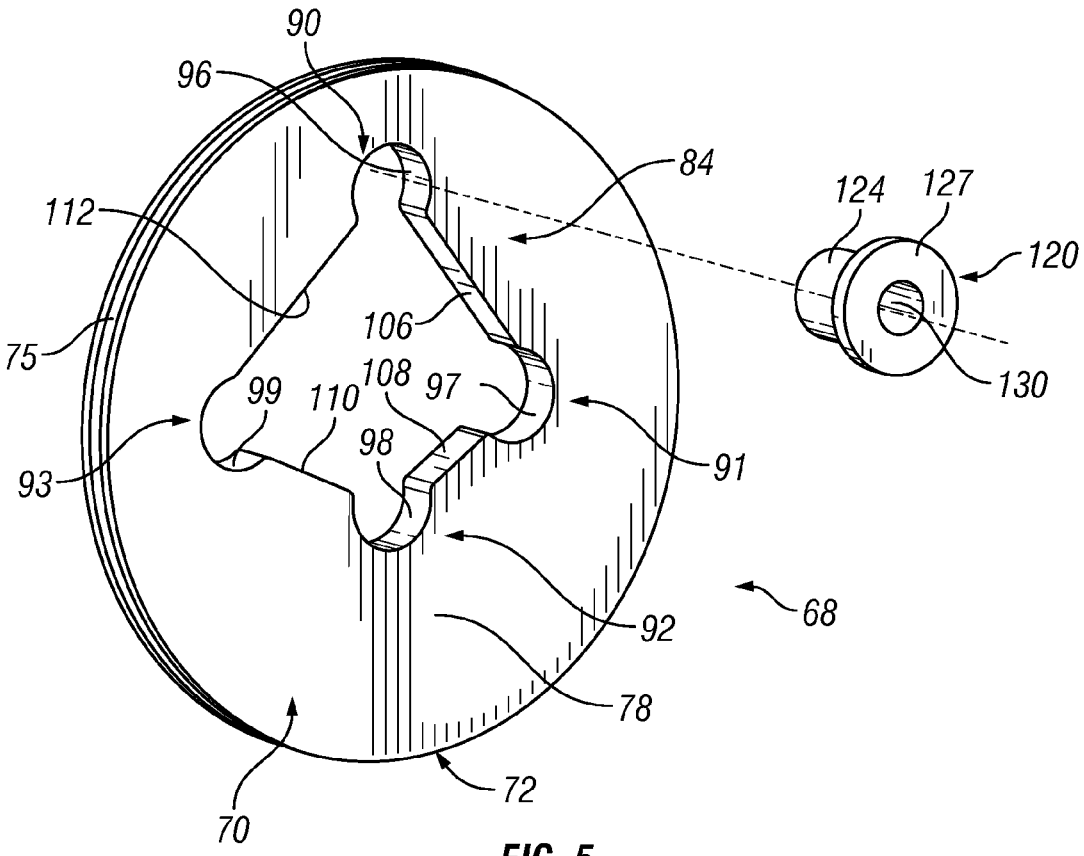
FIG. 5 is an exploded view of the adjustable wall hanger of FIG. 4.

Reference will now be made to FIGS. 4 & 5 which depict an adjustable wall hanger 68 constructed in accordance with another aspect of the exemplary embodiment. Adjustable wall hanger 68 includes a body 70 having an outer edge 72 that is provided with a groove 75. In the exemplary embodiment shown, outer edge 72 extends continuously about body 70 defining a generally circular web 78. Of course web 78 can take on a variety of geometries without departing from the scope of the claims. Adjustable wall hanger 68 includes an adjustment feature 84, which, as will be discussed more fully below, facilitates vertical adjustments for objects supported upon body 70.

In the exemplary embodiment shown, adjustment feature 84 includes a plurality of adjustment zones 90-93 that define a corresponding plurality of distinct orientation positions 96-99 for body 70. In a manner similar to that described above, adjustment zones 90-93 are generally circular enabling body 70 to easily move into a selected one of the plurality of orientation positions 96-99. Of course while shown and described as being generally circular, adjustment zones 90-93 can take on a variety of forms. Adjustment zone 90 is connected or linked to adjustment zone 91 through a first connecting portion 106 having a first length. Similarly, adjustment zone 91 is linked to adjustment zone 92 through a second connecting portion 108 having a second length, adjustment zone 92 is linked to adjustment zone 93 through a third connecting portion 110, having a third length, and adjustment zone 93 is linked back to adjustment zone 90 through a fourth connecting portion 112, having a fourth length. Each of the first, second, third, and fourth connecting portions 106, 108, 110, and 112 are generally linear, and the first, second, third, and fourth lengths are distinct thereby establishing the plurality of distinct orientation positions 96-99.

In further accordance with the exemplary embodiment shown, adjustable wall hanger 68 is configured to rest upon a pin or support member 120. Support member 120 includes a reduced diameter portion 124 configured to nest within adjustment zones 90-93 and a flange portion 127. A central bore 130 extends through flange portion 127 and reduced diameter portion 124. In a manner similar to that described above, adjustable wall hanger 68 is mounted using a wall anchor (not shown) is installed into wall 6. Once installed, support member 120 is mounted to the anchor with a fastener such as a screw (also not shown). Of course it should be understood that support member 120 can take on a variety of forms including both threaded and un-threaded fasteners and/or pins. Also, the particular method of mounting support member 120 to wall 6 is but one example and should not be considered to limit the scope of the claims.

Figure 6:
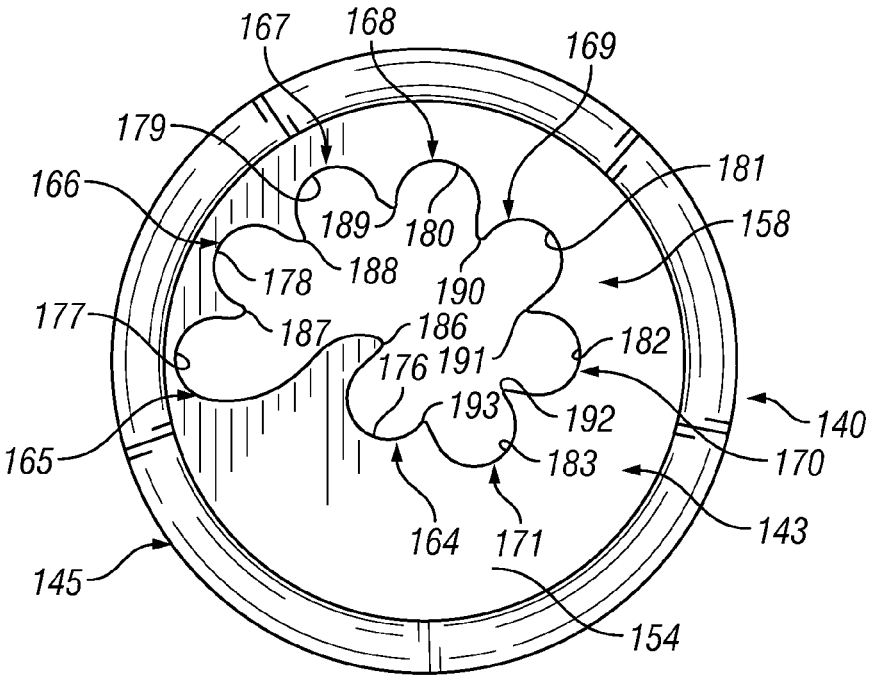
FIG. 6 is a perspective view of an adjustable wall hanger in accordance with still another aspect of the exemplary embodiment.

Reference will now be made to FIG. 6 which depicts an adjustable wall hanger 140 constructed in accordance with yet another aspect of the exemplary embodiment. Adjustable wall hanger 140 includes a body 143 having an outer edge 145 that is provided with a groove (not shown). In the exemplary embodiment shown, outer edge 145 extends continuously about body 143 defining a generally circular web 154. Of course, as noted above, web 154 can take on a variety of geometries without departing from the scope of the claims. Adjustable wall hanger 140 includes an adjustment feature 158, which, as will be discussed more fully below, facilitates vertical adjustments for objects supported upon body 143.

In the exemplary embodiment shown, adjustment feature 158 includes a plurality of adjustment zones 164-171 that define a corresponding plurality of distinct orientation positions 176-183 for body 143. Adjustment zones 164-171 extend along a spiral-like path across web 154 and, in a manner similar to that described above, are generally circular enabling body 143 to easily move into a selected one of the plurality of orientation positions 176-183. Adjustment zones 164-171 are linked through a plurality of connecting portions 186-193 having varying lengths. In the exemplary embodiment shown, connecting portions 186-193 are generally angular surfaces that link adjustment zones 164-171. In a manner similar to that described above, adjustable wall hanger 140 is mounted using a support member (not shown).

Figure 7A:
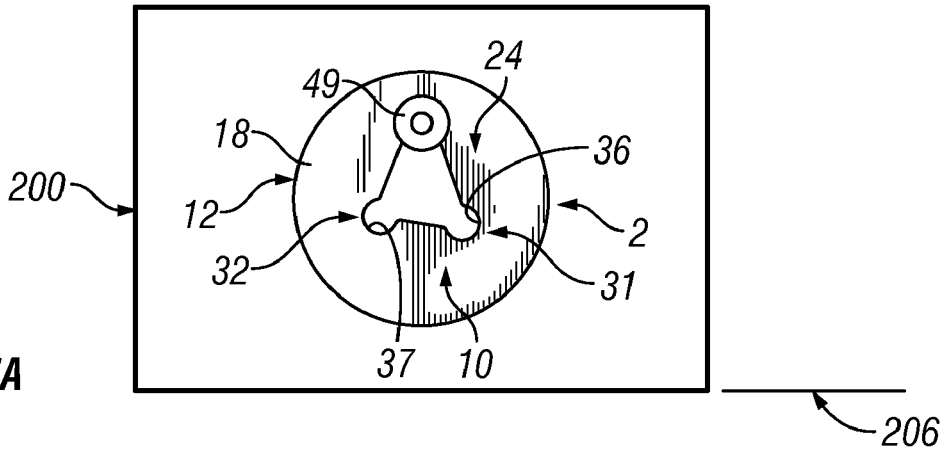
FIG. 7A is a plan view of the adjustable wall hanger of FIG. 1 in a first orientation position.
Figure 7B:
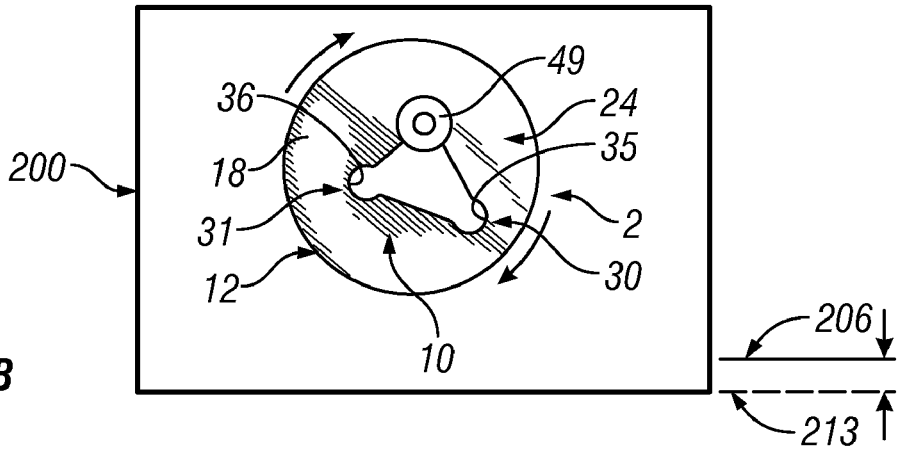
FIG. 7B is a plan view of the adjustable wall hanger of FIG. 1 in a second orientation position.
Figure 7C:
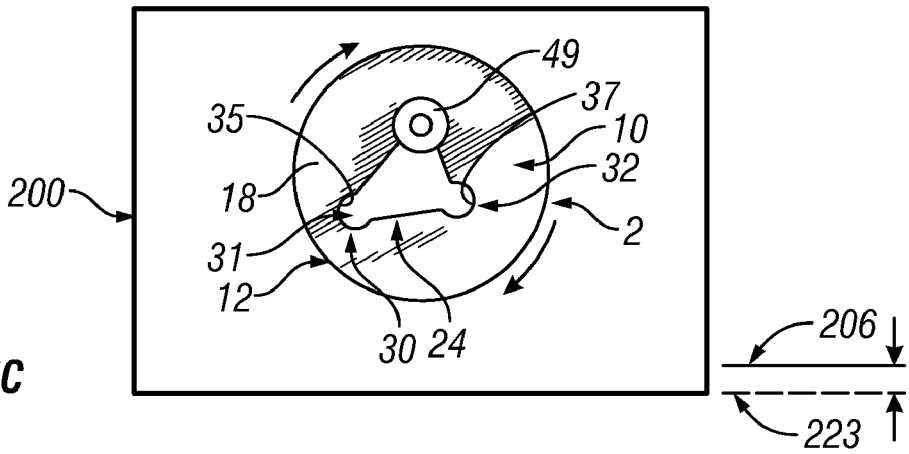
FIG. 7C is a plan view of the adjustable wall hanger of FIG. 1 in a third orientation position.

Reference will now follow to FIGS. 7A-7C in describing the operation of adjustable wall hanger 2. FIG. 7A illustrates adjustable wall hanger 2 supporting a frame 200 in first orientation position 35 thereby establishing a vertical reference 206. In FIG. 7B, adjustable wall hanger is rotated clockwise such that third orientation position 37 rests upon support member 49. In this position, frame 200 shifts vertically, as represented by line 213. Continued clockwise rotation of adjustable wall hanger 2 into second orientation position 36 as shown in FIG. 7C, produces another, distinct, vertical shift, as represented by line 223. With this arrangement, once mounted, a user can selectively adjust vertically the position of an object hanging from the adjustable wall hangers in accordance with the exemplary embodiments. In this manner, the need to remove, repair and re-install hooks or other hanging devices is eliminated.

Finally it is to be understood while one or more embodiments have been shown and described, modifications and substitutions may be made thereto without departing from the spirit and scope of the invention. Accordingly, it is to be understood that the present invention has been described by way of illustrations and not limitation.

The invention claimed is:

1. An adjustable wall hanger comprising:

a body including an outer edge that defines a web, the outer edge including a groove configured and disposed to receive a wire for supporting an object on the wall; and an adjustment feature formed in the web, the adjustment feature including a plurality of adjustment zones having a generally circular shape that define a corresponding plurality of orientation positions for the body, each of the plurality of adjustment zones extending radially across the web and being linked through a one or more connecting portions, the adjustable wall hanger being selectively positionable to support an object on a wall in one of the plurality of orientation positions.

2. The adjustable wall hanger according to claim 1, further comprising: a support member configured and disposed to be fixedly mounted relative to the wall, the body being supported upon the support member it one of the plurality of orientation positions.

3. The adjustable wall hanger according to claim 2, wherein the support member includes a reduced diameter portion operatively coupled to a flange portion, a bore extends through the reduced diameter portion and the flange portion.

4. The adjustable wall hanger according to claim 1, wherein the one or more connecting portions is substantially linear.

5. The adjustable wall hanger according to claim 1, wherein the connecting portion is defined by an angled section.

6. The adjustable wall hanger according to claim 1, wherein the outer edge extends continuously about the body.

7. The adjustable wall hanger according to claim 1, wherein the body is generally circular.

8. The Adjustable wall hangar according to claim 1, wherein the at least one of the plurality of adjustment zones is linked to another of the plurality of adjustment zones through a connecting portion having a first length.

9. The adjustable wall hanger according to claim 8, wherein the another of the plurality of adjustment zones is linked to another of the plurality of adjustment zones through another connecting portion having another length, the length of the connecting portion being distinct from the another length of the another connecting portion.

10. An adjustable wall hanger comprising:

a body including an outer edge that defines a web, the outer edge including a groove configured and disposed to receive a wire for supporting an object on a wall; and an adjustment feature formed in the web, the adjustment feature including a plurality of adjustment zones having a generally circular shape that define a corresponding plurality of orientation positions for the body, each of the plurality of adjustment zones extending radially across the web and being linked by one or more connecting portions, the adjustable wall hanger being selectively positionable upon a support member to support an object on a wall in one of the plurality of orientation positions.

11. The adjustable wall hanger according to claim 10, wherein the support member includes a reduced diameter portion operatively coupled to a flange portion, a bore extends through the reduced diameter portion and the flange portion.

12. The adjustable wall hanger according to claim 10, wherein the one or more connecting portions is substantially linear.

13. The adjustable wall hanger according to claim 10, wherein the connecting portion is defined by an angled section.

14. The adjustable wall hanger according to claim 10, wherein the at least one of the plurality of adjustment zones is linked to another of the plurality of adjustment zones through a first connecting portion having a first length and the another of the plurality of adjustment zones is linked to yet another of the plurality of adjustment zones through a second connecting portion having a second length, the first length being distinct from the second length.

15. The adjustable wall hanger according to claim 10, wherein the outer edge extends continuously about the body.

16. The adjustable wall hanger according to claim 10, wherein the body is generally circular.

17. An adjustable wall hanger comprising:

a body including an outer edge that defines a web, the outer edge including a groove configured and disposed to receive a wire for supporting an object on the wall; and an adjustment feature formed in the web, the adjustment feature including a plurality of adjustment zones having a generally circular shape that define a corresponding plurality of orientation positions for the body, each of the plurality of adjustment zones being linked through a one or more connecting portions and including a central axis, the central axis of each of the plurality of adjustment zones being distinct from the central axis of others of the plurality of adjustment zones, the adjustable wall hanger being selectively positionable to support an object on a wall in one of the plurality of orientation positions.

18. The adjustable wall hanger according to claim 17, further comprising: a support member configured and disposed to be fixedly mounted relative to the wall, the body being supported upon the support member it one of the plurality of orientation positions.

19. The adjustable wall hanger according to claim 18, wherein the support member includes a reduced diameter portion operatively coupled to a flange portion, a bore extends through the reduced diameter portion and the flange portion.

20. The adjustable wall hanger according to claim 17, wherein the one or more connecting portions is substantially linear.

* * * * *